US005455594A

United States Patent [19]

Blasing et al.

[11] Patent Number: 5,455,594

[45] Date of Patent: Oct. 3, 1995

[54] INTERNAL THERMAL ISOLATION LAYER FOR ARRAY ANTENNA

[75] Inventors: Raymond R. Blasing, San Jose; Edwin F. Johnson, Sunnyvale; Douglas G. Lockie, Los Gatos; Cliff Mohwinkel, San Jose; Barry Whalen, Los Altos; Richard S. Withers, Sunnyvale, all of Calif.

[73] Assignee: Conductus, Inc., Sunnyvale, Calif.

[21] Appl. No.: 288,659

[22] Filed: Aug. 10, 1994

Related U.S. Application Data

[63] Continuation of Ser. No. 914,865, Jul. 16, 1992, abandoned.

[51] Int. Cl.[6] ..... H01Q 1/38; H01Q 15/24

[52] U.S. Cl. ..... 343/700 MS; 343/909; 343/756

[58] Field of Search ..... 343/909, 700 MS, 343/756, 700 R; 505/201; H01Q 1/38, 15/02, 15/24, 19/00

[56] References Cited

U.S. PATENT DOCUMENTS

| | | | |
|---|---|---|---|
| 3,864,690 | 2/1975 | Pierrot | 343/872 |
| 3,914,464 | 10/1975 | Thomasson | 427/54 |
| 3,925,783 | 12/1975 | Bleday | 343/705 |
| 4,570,166 | 2/1986 | Kuhn | 343/872 |
| 4,656,487 | 4/1987 | Sureau et al. | 343/909 |
| 4,684,954 | 8/1987 | Sureau et al. | 343/909 |
| 4,701,765 | 10/1987 | Arduini | 343/897 |
| 4,847,506 | 7/1989 | Archer | 250/515.1 |
| 4,897,151 | 1/1990 | Killackey | 156/630 |
| 4,901,086 | 5/1990 | Smith | 343/909 |
| 5,103,241 | 4/1992 | Wu | 343/909 |
| 5,105,200 | 4/1992 | Koepf | 343/700 |

OTHER PUBLICATIONS

"Fundamental Superstrate (Cover) Effects on Printed Circuit Antennas," N. G. Alexópoulos, D. R. Jackson, *IEEE Transactions on Antennas and Propagation*, vol. AP–32, No. 8, pp. 807–815, Aug. 1984.

"Five Novel Feeding Techniques for Microstrip Antennas," D. M. Pozar, *IEEE Antennas and Propagation Society, Int'l Symposium Digest*, paper AP23–1, Jun. 1987.

"Analysis of an Infinite Phased Array of Aperture Coupled Microstrip Patches," D. M. Pozar, *IEEE Transactions on Antennas and Propagation*, vol. AP–37, No. 4, pp. 418–425, Apr. 1989.

"Design of a Meanderline Polarizer Integrated with a Radome," A. C. Ludwig, M. D. Miller, G. A. Wideman, *IEEE Antennas and Propagation Society, Int'l Symposium Digest*, pp. 17–20, Jun. 1977.

"A New Approach to the Design of Meander–line Circular Polarizer," X. Liang–gui, W. Shi–jin, C. Dai–zong, *IEEE Antennas and Propagation Society, Int'l Symposium Digest*, paper AP05–8, Jun. 1987.

(List continued on next page.)

*Primary Examiner*—Donald Hajec
*Assistant Examiner*—Hoanganh Le
*Attorney, Agent, or Firm*—Judith A. DeFranco; Kimberley Elcess

[57] ABSTRACT

An array antenna includes a means of thermally isolating the feed network from the space illuminated by the antenna. Filtering layers are incorporated into the structure between the feed and the radiating patches. These filtering layers are transparent to radiation in the frequency range of operation of the antenna, primarily microwaves and millimeter waves, but reflect much shorter wavelengths such as infrared and visible light. This rejection of short wavelengths results in reduced heating of the feed network and so to a reduced heat load on a cooling system. One preferred embodiment employs the radiation shield to advantage by incorporating superconductive elements in the antenna. These elements can be cooled efficiently enough to be practical due to the rejection of heat by the incorporated filtering layers.

8 Claims, 6 Drawing Sheets

OTHER PUBLICATIONS

"An Octave Bandwidth Meanderline Polariser Consisting of Five Identical Sheets," D. A. McNamara, *IEEE Antennas and Propagation Society, Int'l Symposium Digest,* pp. 237–240, Jun. 1981.

"Experimental Results on a 12–GHz 16–element Multilayer Microstrip Array with a High–$T^c$ Superconducting Feed Network," J. S. Herd, et al., presented at the *IEEE Antennas and Propagation Society, Int'l Symposium* Aug. 1992.

"Antenna Applications of Superconductors," R. C. Hansen, *IEEE Trans. on Microwave Theory and Techniques,* vol. 39, No. 9, pp. 1508–1512, Sep. 1991.

INTERNAL THERMAL ISOLATION LAYER FOR ARRAY ANTENNA

CROSS REFERENCE TO RELATED APPLICATIONS

This is a continuation of Ser. No. 07914,865, filed Jul. 16, 1992, now abandoned.

FIELD OF THE INVENTION

This invention relates to antenna technology for use in satellite and terrestrial applications. More particularly it relates to a structure incorporating a radiation shield with a superconducting array antenna. The radiation shield is transparent to microwaves and millimeter waves, but opaque to radiation of significantly shorter wavelengths.

BACKGROUND OF THE INVENTION

The desirability of broadband antenna systems operating in the microwave and millimeter wave frequency bands is by now indisputable. One of the most promising technologies for producing such systems for space-based communications is a phased array antenna which uses superconductors instead of normal metal for the network that distributes and controls the phase and amplitude of the signals to the radiating elements (the feed network). Superconductors have very low conduction loss when operated at temperatures below their superconducting transition temperature, $T_c$.

This low distribution loss enables the use of a single or a relatively small number of transmit or receive amplifiers instead of having an amplifier associated with each radiating element in the antenna array. Superconducting delay lines can be used for the low-loss and wideband control of the phase of the radiated signals, providing good beam control over a wide band not possible with ordinary phase shifters. Low-loss superconducting switches have been demonstrated for producing switched delay modules. Superconducting flux-flow transistors have also been demonstrated which can perform phase and amplitude control.

As is quite often the case with scientific and engineering advances, however, the use of superconductors in satellite-based antenna systems brings in its own particular problems. The most critical in many applications is the necessity to keep the operating temperature of the superconductor materials well below the superconducting transition temperature. This requires a cooling system for the active elements.

The cooling system must meet stringent requirements for flight qualification. Of paramount importance are its size and weight. Once in orbit, the size and weight are insignificant over a wide range, but achieving orbit is critically affected by these considerations. In brief, cooling systems for antennas installed in satellites must be as small as possible. To achieve acceptable cooling power in a small enough package the cooling load must be reduced to a minimum. Thus, a space qualified cooling system will include not only a heat extractor, but also provisions for eliminating heat build-up in the first place. One such provision is a radiation shield that blocks infrared (IR) and visible light that can act to heat the antenna and feed structure. The requirements are not as stringent for ground-based systems, but for terrestrial applications the economic advantages of a reduced heat load and smaller cooling system may be even more important.

For practical applications it is crucial that the cooling system not interfere with the intended operation of the antenna. In the present case the implication is that the radiation shield must be transparent to the frequencies of interest for communications, or at least should not disturb the electric and magnetic field distributions in and near the antenna in a way that interferes with the antenna's operation.

DISCUSSION OF THE PRIOR ART

Patch arrays, fed by planar structures such as microstrip, are well known in the literature. A single patterned layer, backed by a ground plane, contains both the distribution network and the radiating patches. These arrays suffer both from excessive electrical loss in the feed network and from a limited electrical bandwidth, typically a few percent. The bandwidth can be extended to 8 to 10 percent by the use of electrostatic coupling between the feed network and a second array of radiating patches. FIG. 1 shows an electrostatically coupled patch array antenna presented by J. S. Herd, et al., in an article entitled "Experimental results on a 12-GHz 16-element multilayer microstrip array with a high-$T_c$ superconducting feed network," to appear in the Digest of the 1992 IEEE Antennas and Propagation Symposium. The antenna described therein reduces distribution losses when compared to conventional electrostatically coupled patch arrays by using a cooled superconducting feed network. The authors also recognized that some thermal insulation is obtained by evacuating the space between the feed and radiating layers. However, a significant amount of heat transfer to the cooled feed network occurs by the entry of infrared radiation from the environment within view of the antenna.

Dichroic layers, which pass radiation of certain wavelengths while reflecting radiation of other wavelengths, have been fabricated for various applications using a number of techniques. Most involve the layering of dielectric materials of differing indices of refraction or the formation of grooves in dielectric layers. These techniques have been reviewed by K. D. Moeller and W. G. Rothschild in Far-infrared Spectroscopy, Wiley-Interscience, New York (1971) and an example of the latter is shown in FIG. **4*a*. The metal islands may be of random size, shape, and location, as shown in FIG. 4*b***, to improve transmission properties, and they may be selectively connected in order to modify the electrical characteristics of the antenna. Surfaces made of electrically isolated metallic islands are also of interest for this application. Radiation with wavelengths much less than the dimensions of these islands will be reflected, while longer wavelength radiation will be transmitted. Such structures (known as capacitive meshes) are also discussed in the book cited above. A similar concept is the quasi-optical filter, an array of metal elements that can be designed to transmit radiation in a band with wavelength of approximately equal to the characteristic length of the elements.

Finally, superinsulation is often used to shield cryogenic vessels and space structures from incident infrared radiation. Superinsulation consists of sheets or foils of material of high infrared reflectivity, such as smooth metals, separated by evacuated layers that are stood off by layers of lace-like material with low thermal conductivity.

OBJECTS AND ADVANTAGES

It is therefore an object of this invention to provide a high performance microwave and millimeter wave antenna system for operation on, e.g., communications satellites. It is a further object of the invention to provide an antenna system which presents a reduced heat load to the cooling system used to maintain the superconducting elements at a temperature well below their superconducting transition temperature. This is accomplished in one embodiment of this invention by incorporating a radiation shield that is an integral part of the antenna. This integration of the two functions leads to a reduced load on the cooling system. This reduction, in turn, allows for the use of a much smaller cooling system than would otherwise be required. The reduced payload leads to a much less expensive launch, and so to the possibility of an increased number of launches and communications satellites.

Yet another object of the invention is to provide a general purpose scheme for reducing the heat load on an antenna cooling system. In addition to the integral heat shield, the invention provides for the addition of a thermal shroud which is transparent to long (microwave and millimeter wave) wavelengths but which reflects IR and visible radiation. This shroud further reduces the build-up of heat in the antenna without affecting the efficiency of the antenna in either the transmit or receive mode.

It is still another object of the invention to reduce the duration of blind spells caused by direct insolation from the sun, the moon, or the earth. The reduction in blind time leads to a smaller number of antennas per satellite, again reducing the cost of each satellite. Another advantage of the reduced blindness is a reduced likelihood that important information will be lost during these periods of intense incident radiation.

It is yet another object of the invention to provide very large reductions in side lobe intensity compared with major lobe intensity. This eliminates interference between this system and other, possibly hostile, transmit and receive systems, as well as reducing eavesdropping. This reduction of side lobe intensity relative to main lobe intensity is largely due to the use of a superconducting distribution network. Because superconductors are non-dispersive they can operate over a wide band. Due to their very low conduction losses, true time delay can be used for "phase shifted" steering of the far-field pattern. Thus, over a very wide range of scan angles and frequency, the narrow spatial distribution of radiation is not distorted and side lobes can be suppressed without sacrificing the quality of the main lobe.

SUMMARY OF THE INVENTION

The present invention involves the application of dichroic layers to microwave and millimeter wave antennas with cryogenic feed networks. These dichroic layers act as filters to reject short wavelength radiation which effectively heats the antenna, while transmitting the long wavelength radiation used for communications. Furthermore, improvements to filtering layers are described which will enhance their function in this application. Specifically, layered dielectrics with many layers (more than 20) with gradually increased, or "chirped," thicknesses are described. These offer a broader range of rejected wavelengths than do previously known multilayers. Patterns of metallic islands are also described which efficiently perform the desired low-pass function. In addition, the selective use of normal-metal films with high IR reflectivity, such as gold, within the antenna is described.

BRIEF DESCRIPTION OF THE DRAWINGS

Please note that the attached drawings, particularly the cross-section views, are not to scale. They are intended to depict the relationship of the layers to each other and to point out the important features of the invention.

FIG. 1 is a schematic drawing of a prior art electrostatically coupled array antenna.

FIG. 4 is a schematic representation of a pattern of metal islands suitable for transmitting microwaves and millimeter waves while reflecting infrared and visible light.

DETAILED DESCRIPTION OF THE INVENTION

Figure 1A:
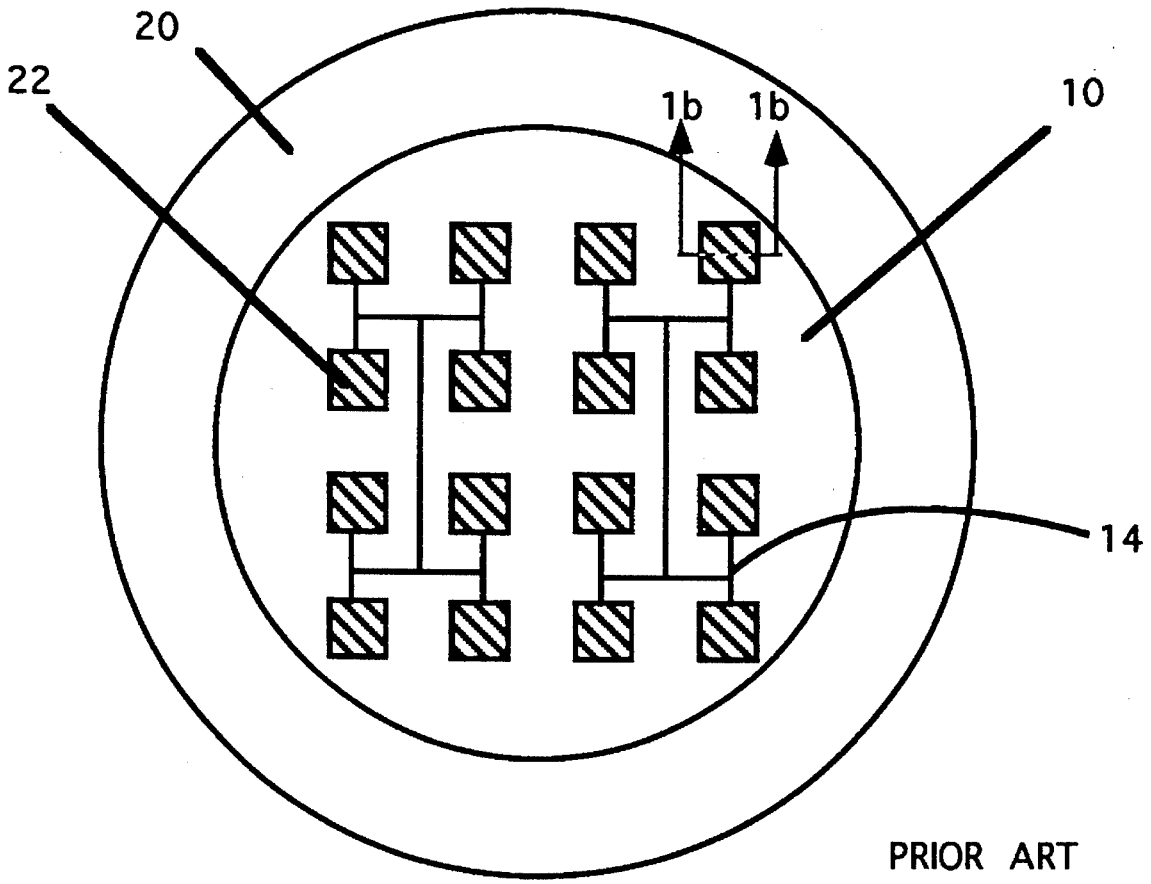
FIG. 1*a* is a top view.
Figure 1B:
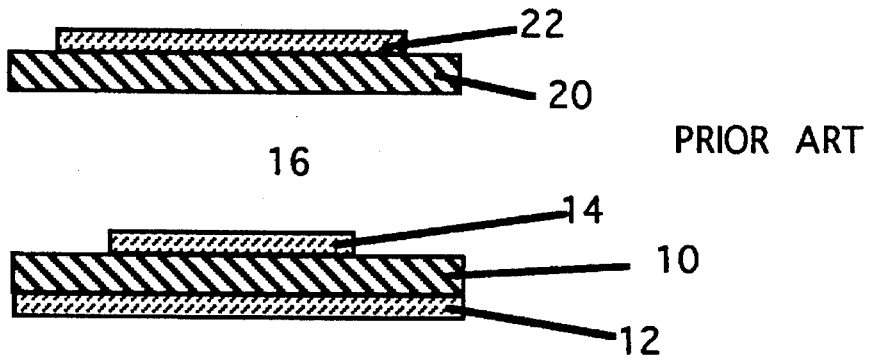
FIG. 1*b* is a cross section.

FIG. 1 shows an example of a prior art microstrip array antenna. A top view is shown in FIG. 1*a*. A feed network 14 is formed on one side of a substrate 10, and a ground plane 12 is deposited on the opposite side of the substrate. The material of substrate 10 must be compatible with processing steps involved in the deposition of superconductive material, and must have acceptably low dielectric loss for the intended antenna application. On a second substrate 20, radiating patches 22 are formed of a normal metal. The material of second substrate 20 is chosen to have low dielectric loss and to support deposition of the normal metal radiating patches 22.

The radiating patch 22 layer consists of an array of electrically isolated, electromagnetically coupled radiating patches 22. This layer 22 can be made of a normal metal such as copper, and so can be at the ambient temperature; moderate resistance in the radiating patches 22 does not cause excessive loss in the antenna. The space 16 between the feed 14 and radiating 22 layers is evacuated, eliminating heat transfer from patch 22 to feed 14 by conduction or convection.

The extremely low surface resistance of the superconductor used for the feed 14 aids in minimizing the losses of the antenna, but only as long as the superconducting layer is kept at a low temperature, approximately that of liquid nitrogen (77 K.). However, there is a significant flux of infrared radiation, about 500 $W/m^2$ for a 300 K. background, incident upon the feed layer 14. This heat load is unacceptable for a reasonably sized cooling system in a satellite. Of the array face, only the metal radiating patch 22 effectively reflects the incident infrared radiation. The remaining radiation is transmitted through the dielectric material 20 supporting the radiating patches 22 and is ultimately partially absorbed by the microstrip feed network 14. The most severe absorption will, in fact, take place in the high temperature superconductor layers which absorb IR very efficiently. If the ground plane 12 is made of a high temperature superconductor it will suffer the most absorption by virtue of its greater exposed area.

Figure 2:
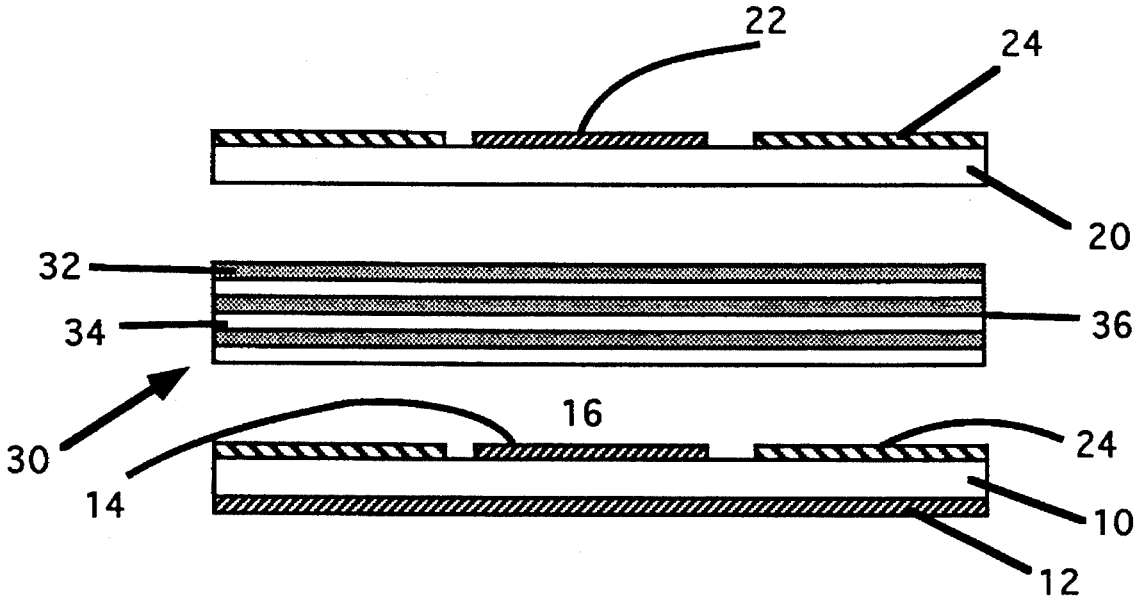
FIG. 2 is a cross-sectional view of the subject invention employing a microstrip feed layer.
Figure 5:
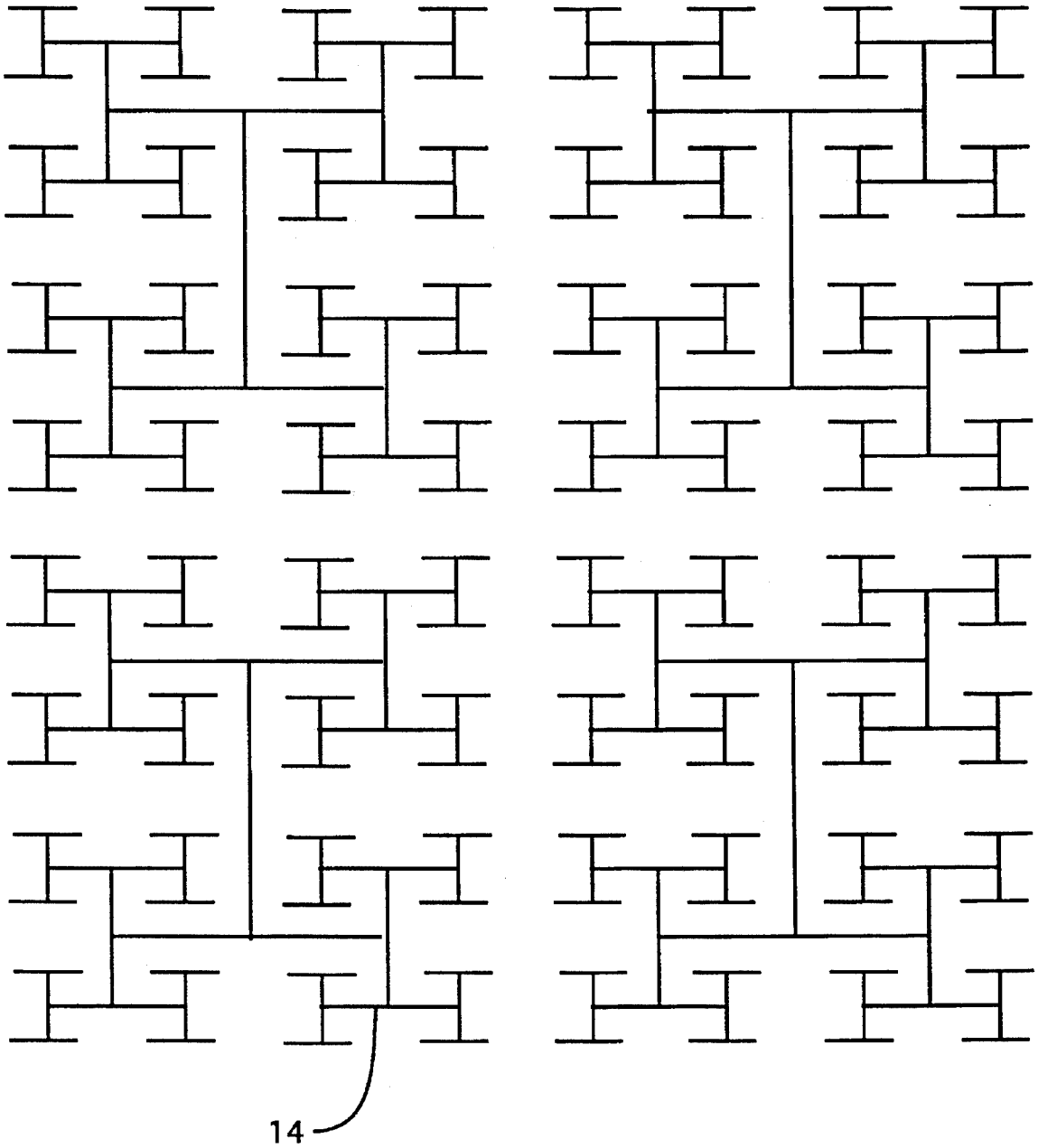
FIG. 5 is a plan view of the microstrip feed layer of FIG. 2.

A cross-sectional view of the subject invention is shown in FIG. 2. The antenna consists of a ground plane 12, a feed network 14, and radiating patches 22. The feed layer 14 in this case is a microstrip circuit, an example of which is shown in FIG. 5 in plan view. The microstrip feed layer 14 consists of many cascaded power dividers that eventually feed into the terminations of the microstrip. This feed layer 14 is made from a high temperature superconductor, e.g., $YBa_2Cu_3O_7$. Also incorporated is a filtering layer 30, which is depicted here as made up of at least two layers 32, 34 with an interface 36 between them. As is apparent from FIG. 2, this filtering layer 30 is internal to the antenna as it lies between at least two of the elements (ground plane 12, feed network 14, and radiating patches 22) of which the antenna consists. Infrared reflecting layers 24 are added to part of the radiating patch layer 22 and to the feed layer 14.

The filtering layer 30 is transparent to long wavelength radiation, with wavelengths from about 1 mm to about 1 m. This allows the desired radiation to pass into and out of the antenna unimpeded. Shorter wavelength, that is less than about 0.1 mm, radiation, however, is reflected or absorbed by the filtering layer 30 to reduce the heating of the feed 14 and ground plane 12 layers which are composed of superconductive material which must be maintained at a low temperature. The property of selective transmission of one wavelength with respect to another is known as "dichroism" (from "two colors") and the filtering layer 30 can be called a dichroic layer. The filtering layer 30 consists of at least two individual layers 32, 34 with an interface 36 between them. Two examples of filtering layers are shown in FIGS. 3 and 4.

Figure 3A:
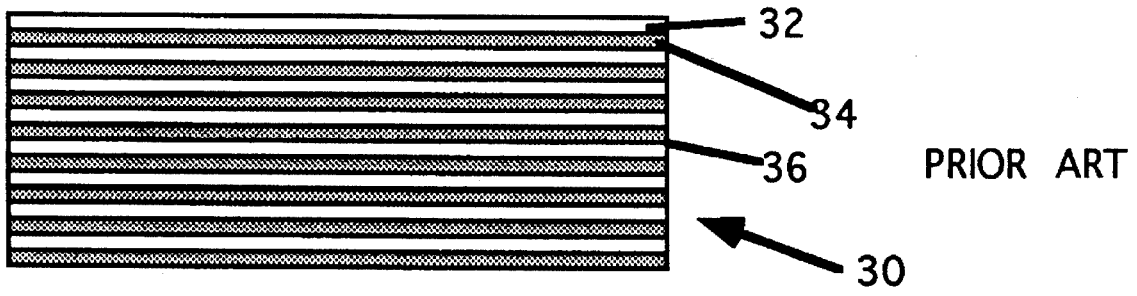
FIG. 3*a* is an example of a prior art filtering layer.

One type of prior art dichroic layer 30 is shown in FIG. 3*a*. It consists of alternating layers 32, 34 of materials having differing indices of refraction. A reflection, whose amplitude is is approximately proportional to the difference of the two indices of refraction divided by their sum, occurs at each interface 36, reducing the amplitude of radiation that travels on through by a corresponding amount. Nearly total reflection of a wave occurs when the thickness of each of a pair of layers 32, 34 is an odd number of quarter wavelengths of the radiation. This constructive reflective interference results in "stopbands" near these wavelengths. The width of the stopbands depends on the difference in the indices of refraction of the two adjacent layers 32, 34. As far as we know, no such multilayer dichroic structures have been used to reject IR, visible, and ultra-violet light while transmitting microwave and millimeter radiation.

An alternative approach is to monotonically and gradually vary the thickness of the alternating layers 32, 34 in a dichroic multilayer 30. Such a "chirped" multilayer structure 30', schematically depicted in FIG. 3*b*, will reflect wavelengths from those which are four times the thickness ($d_1$) of the thinnest layer 32*a*, 34*a* to those which are four times the thickness ($d_2$) of the thickest layer 32*c*, 34*c*. Because the third and higher odd harmonic responses of these structures are strong, it is necessary only to cover a range of layer thicknesses of a factor of 3, i.e., $d_2=3d_1$, in order to reflect all radiation with $\lambda<4d_2$. The change in layer thickness must be gradual enough, and hence the total number of layers sufficient, to provide near total reflection across this band.

Figure 3B:
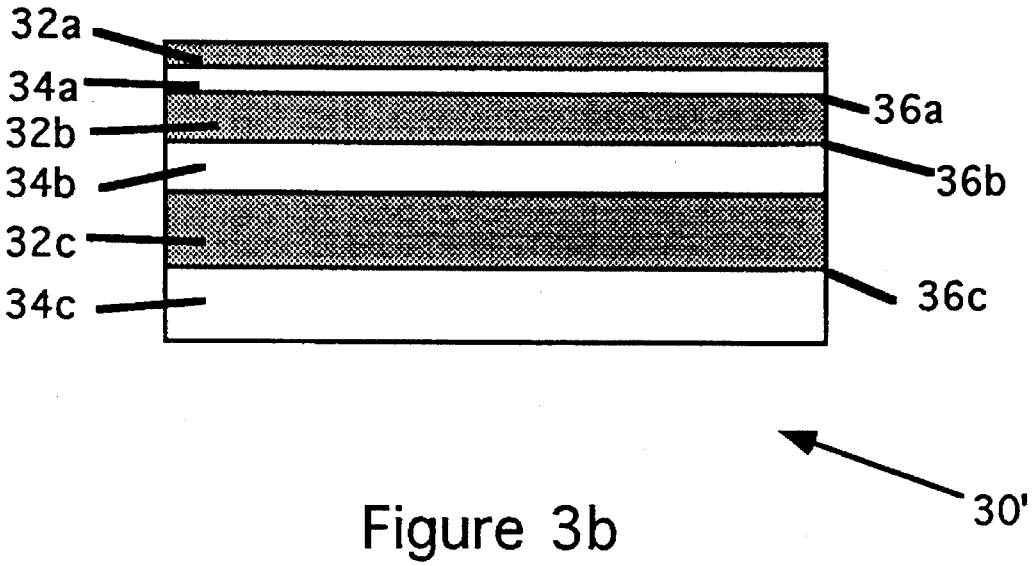
FIG. 3*b* is a schematic representation of the chirped filtering layer of the present invention.
Figure 4A:
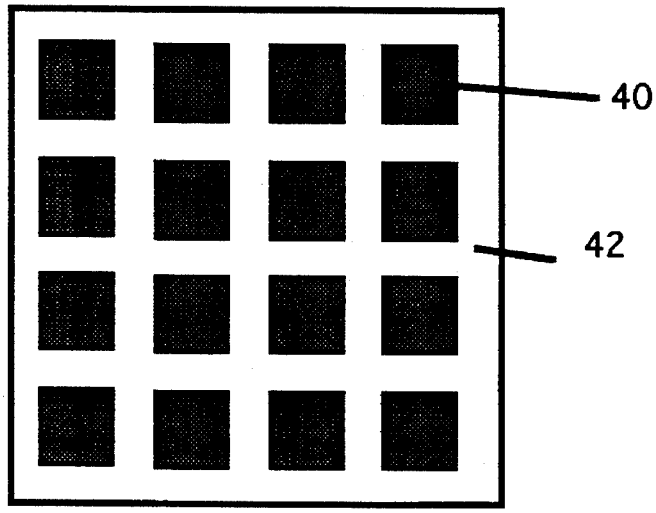
FIG. 4*a* shows a regular array.
Figure 4B:
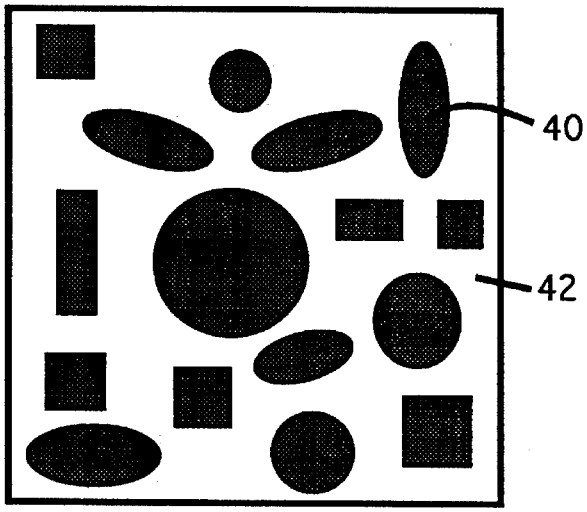
FIG. 4*b* shows a randomized array of metal islands.
Figure 4C:
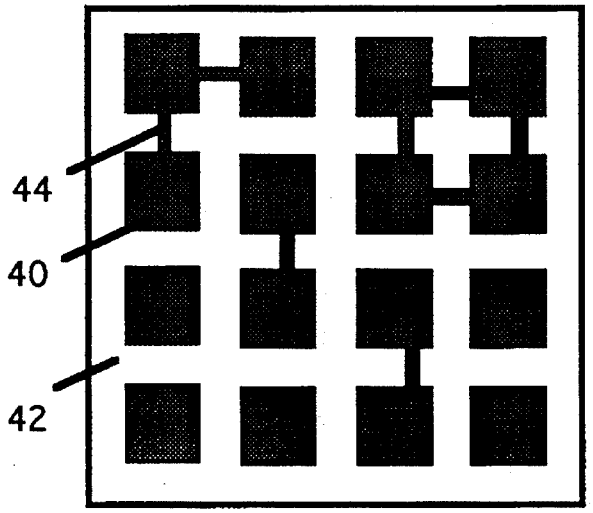
FIG. 4*c* depicts a selectively connected regular array.

FIG. 4 shows a second type of filtering structure 30 with the desired low-pass response. It consists of a single metal layer 40 on a dielectric substrate 42, corresponding to the two dissimilar dielectrics 32, 34 in the filtering layer of FIG. 3. The metal layer 40 is patterned into islands whose dimensions are small compared to the wavelengths to be transmitted and large compared to the wavelengths to be reflected. In the present invention the islands 40 are approximately 0.1 mm, that is, a tenth the size of the minimum wavelength to be transmitted. This arrangement is similar in concept to a quasi-optical filter, which is an array of metal islands whose shape and pitch cause it to transmit radiation of wavelengths of approximately equal to the characteristic length of the pattern. In the present case each of the islands has a characteristic dimension in the plane substantially shorter than approximately 1 millimeter, which is the minimum wavelength at which transparency is desired. The metal islands 40 may be of random size, shape, and location, as shown in FIG. 4*b*, to improve transmission properties. They may also be selectively connected, as in FIG. 4*c*, in order to modify the electrical characteristics of the antenna. The connections 44 may be made of the same material as the islands 40 or with any other conducting material which is compatible with the substrate 42.

EXAMPLES OF PREFERRED EMBODIMENTS

In the present application it is desirable to exclude radiation of wavelengths which dominate the blackbody spectrum of objects with temperatures of about 100 to 400 K., the apparent temperature of the brightest objects seen by an earth-orbiting satellite. It is also desirable to exclude the near infrared, visible, and ultra-violet light in the solar spectrum. Such broadband coverage is difficult to achieve by the prior art methods. Although visible and shorter wavelengths may be excluded by the use of materials such as high resistivity silicon (single crystal, polycrystalline, or amorphous) which transmit longer wavelengths but which absorb shorter wavelengths by carrier pair generation, it is still be difficult to exclude the entire infrared spectrum.

The present invention drastically reduces the high heat load usually seen by the ground plane and feed network of a microwave antenna using several means. In one preferred embodiment of the present invention, multiple dichroic structures, each excluding one region of the spectrum, are used. These graded thickness thermal filters, as shown in FIG. 3*b*, are somewhat analogous to chirp filters, but chirp filters are not normally used in two such different regions of the electromagnetic spectrum. Design procedures for microwave chirp filters are detailed by R. S. Withers, A. C. Anderson, P. V. Wright, and S. A. Reible, "Superconductive tapped delay fines for microwave analog signal processing," *IEEE Trans. Magnetics*, 19, 480 (1983),and by J. T. Lynch, A. C. Anderson, R. S. Withers, and P. V. Wright in U.S. Pat. No. 4,499,441 issued 12 Feb. 1985, hereby incorporated by reference.

Figure 6:
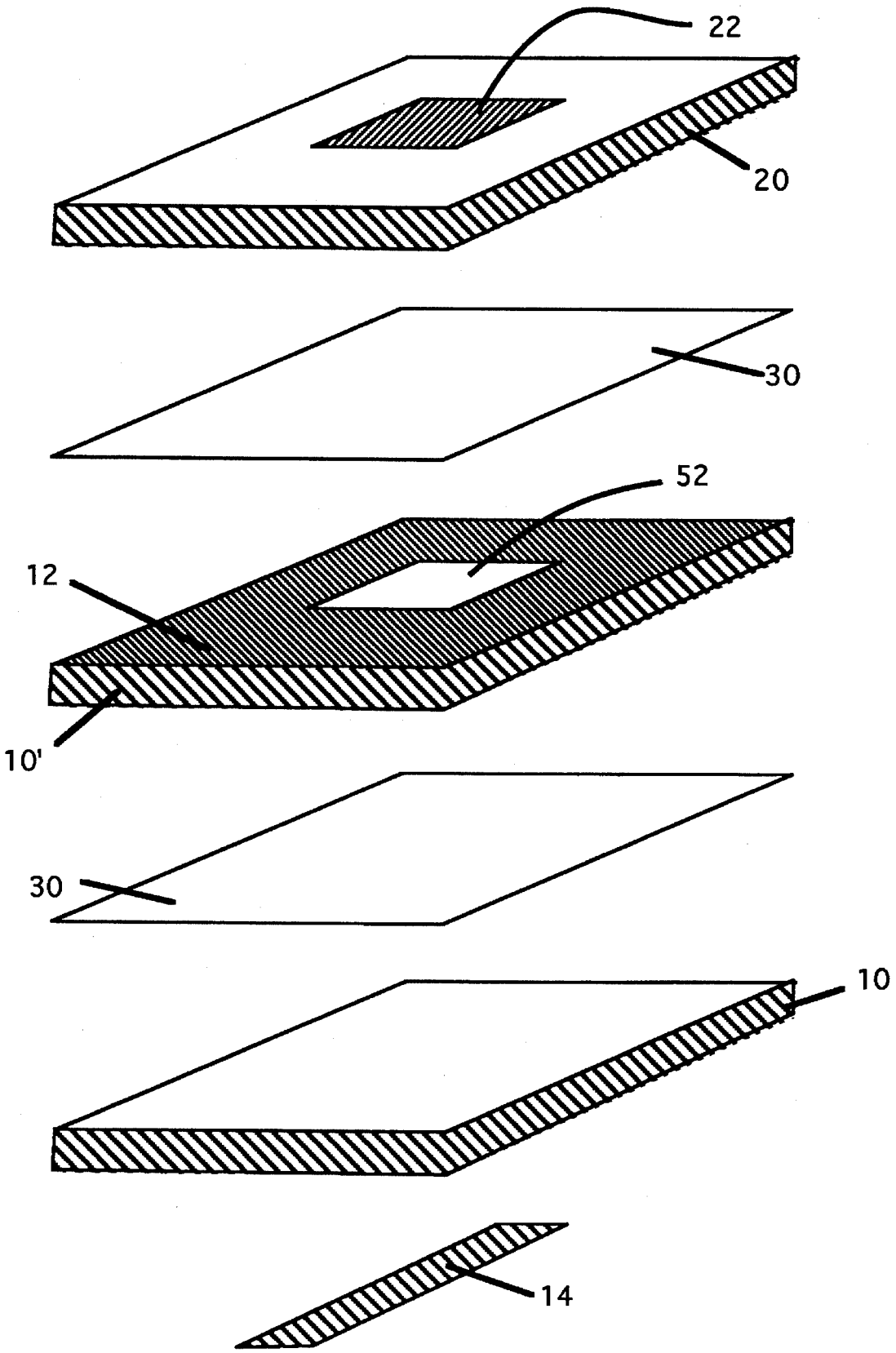
FIG. 6 is a schematic exploded view of the microstrip configuration used for the antenna in a preferred embodiment.

Referring to FIG. 6, we see the arrangement of the above-described elements in one preferred embodiment. The upside-down microstrip configuration is chosen for maximum rejection of incident thermal energy, although other configurations such as stripline, barline, and coplanar waveguide could be used. As seen in FIG. 6, the microstrip feed network 14 is patterned in a superconducting film on one side of a dielectric support substrate 10. The ground plane 12, also superconducting, is patterned either on the other side of the substrate 10, or onto another substrate 10'. In the latter case, the two substrates 10, 10' are bonded together so that at least one thickness of dielectric materials intervenes between the feed layer 14 and the ground plane 12. In FIG. 6, the microstrip feed 14 is patterned on one substrate 10 while the ground plane 12 is patterned on a second substrate 10'. When assembled, the back sides of each substrate 10, 10' are in contact with the dielectric layer 30. The ground plane 12 is coated with an IR-reflective material, like gold, on the side opposite the feed layer 14 and is patterned to open apertures in registry with the primary radiating patches.

In the present case this substrate 10 is $LaAlO_3$. In other cases it could be $CeO_2$- or MgO-buffered sapphire (single crystal $Al_2O_3$), yttria-stabilized zirconia (cubic zirconia, zirconium oxide doped with a few percent of yttrium oxide to stabilize the desired crystal structure), or any other substrate material which can support the deposition of high temperature superconductor materials, and which has other desirable properties, such as an appropriate dielectric loss tangent. The criteria for choosing an appropriate substrate material for use in microwave applications of high temperature superconductors are well known. Substrates are generally a few hundred micrometers in thickness, with a range from about 25 μm to about 500 μm.

In the preferred embodiment, $YBa_2Cu_3O_7$ is used as the superconducting material. Other superconductors appropriate for this application include all of the cuprate superconductors having superconducting transition temperatures above about 30 K., including thallium- and bismuth-based cuprate compounds. All of these materials can be made in thin-film form, that is, with layer thicknesses from about 10 nm to about 1 μm. In addition to the superconducting transition temperature of the material, its surface resistance, $R_s$, is an important design consideration. The incorporation of insulating and dielectric layers may improve the crystal growth and the microwave characteristics of the superconductive structure.

A multilayer of filtering dichroic material 30 is placed atop the coated ground plane 12. Thin layers of dielectric material, like $Si_3N_4$, deposited on polyimide would serve well as the filtering layer material 30. Such layers are available from several vendors, including Optical Coatings Laboratory, Inc. (OCLI) in Santa Rosa, Calif. The substrate for the dichroic material is typically a few tens of micrometers thick, but can be as thick as a millimeter. The dielectric layers deposited on the substrate range from about 1 nm to a few hundred micrometers. This filtering layer 30 may be in physical contact with the ground plane 12, or there may be an intervening layer of dielectric lace or filigree (not shown). The lace would serve to reduce the heat transferred by conduction between the ground plane 12 and the filtering layer 30. If an intervening layer is used, the air spaces may be evacuated to further reduce conductive and convective heat transfer. The lace may be made of silk or cotton, or may be an aerogel material whose very structure can be described as an extremely fine lace.

The radiating patches 22 are made of normal metal, like copper, deposited on a dielectric support substrate 20. Moderate resistance in the radiating patches 22 does not cause excessive loss in the antenna. The patches are typically several skin depths thick, so the thickness chosen depends on the frequency of operation. Because the metal need not be epitaxial to its substrate 20, this substrate can be made of any thin dielectric material without regard to crystal growth requirements. It may be crystalline (single or polycrystalline) or amorphous. Suitable materials include glass, polyimide, and quartz. The thickness of the substrate 20 depends on the frequency and bandwidth, but it is typically about one-tenth of a wavelength. Again the substrate 20 may be spaced apart from the filtering layers 30 by aerogels, silk lace, low density foams, honeycombs, or a filigree of thermally insulating material.

The above embodiment greatly reduces the heat radiation incident on the superconducting layers of the antenna. For extreme environments, however, additional reduction of the heat load may be desirable. If so, the remaining (unmetallized) pan of the radiating layer 22 can be covered with a dichroic surface 30 which transmits microwaves and millimeter waves but reflects infrared radiation, and one or more similar dichroic layers can be placed between the microstrip feed layer 14 and the ground plane 12. The thermal filtering layers 30 can be inserted between any structures that may accompany the antenna, such as electromagnetic wave polarization filters ("polarizers") or parasitic elements ("parasitics") which may be added to improve bandwidth, polarization diversity, polarization conversion, and thermal isolation. One way to incorporate the thermal filter into a polarizer structure is to deposit the polarizer pattern in metal on one side of a substrate. On the other side, a dielectric thermal filter structure is deposited. Many of these layers can then be stacked together to form the completed polarizer structure. If desired, the individual layers are spaced apart with, for example, silk, and the resulting air spaces are evacuated to further improve insulation.

The dielectric thermal filter may be constructed so as to exhibit non-uniform dielectric characteristics. In this case, the filter layer would modify the beam in addition to excluding short wavelength radiation. For example, the individual layers may be stacked in an appropriate sequence to form a lens, or to form a structure capable of reducing the relative intensity of side lobes.

In other applications, the part of the microstrip feed network 14 adjacent to the superconducting circuitry can be covered with an IR reflecting layer, like gold. This last is necessary only if the ground plane 12 absorbs IR effectively, that is, if it is made of a high-temperature superconductor. In this case, an upside-down microstrip configuration may be most appropriate. FIG. 6 shows an example of this kind of structure. Here the feed network 14 is coupled to the radiating patches 22 through apertures, or slots, 52 in the ground plane 12, which lies between the feed 14 and radiating 22 layers. The ground plane 12, in turn, is coated with an IR reflective layer 24 like gold. This not only effectively eliminates impinging IR radiation from outside the antenna, it also reduces unwanted radiation from the feed network 14.

The radiating patches 22 are electromagnetically, or capacitively, coupled to the feed 14. Each individual radiating patch 22 acts as a point source for the microwave radiation emitted by the antenna array. Because all of the radiating patches 22 operate at the same frequency, the waves from the individual point sources add constructively to produce a plane wave at a distance of many wavelengths from the antenna at an angle prescribed by the relative element phasings. In order for this plane wave to be produced, the electric and magnetic fields near the feed 14 and the radiating patches 22 must not disturb the nascent wave. Thus, the choice of materials for use between the two layers is circumscribed. Strictly speaking, the IR reflective layers 24 internal to the antenna do not have to be transmissive to a microwave plane wave, as the latter has not yet been formed inside the antenna. Rather, it must allow the capacitive coupling between the microstrip feed 14 and the radiating patch 14, and not detrimentally alter the local magnetic field configuration.

In other embodiments of the invention, one replaces the layered dielectric filtering layers 30 with the structure of FIG. 4. A quasi-optical filter with a large fill factor (ratio of metallized area to total area) and a passband in the appropriate region of the microwave spectrum would serve well in the current application by excluding out-of-band signals as well as the infrared radiation. As for the radiating patches 22, the choice of substrate 42 is based on convenience, low dielectric loss, and mechanical strength since epitaxial crystal growth will not be necessary for the metal islands 40. The metal islands 40 may be of random size, shape, and location, as shown in FIG. 4*b*, to improve transmission properties, and they may be selectively connected in order to modify the electrical characteristics of the antenna.

Further isolation from the external thermal environment can be accomplished by surrounding the antenna module with an IR-reflective shroud. This shroud is made of the same types of material as the integral filtering layers 30, that is, metal islands on a dielectric substrate or standard or chirped multilayers of pairs of dissimilar dielectrics. It serves the same function, i.e., to block incident short wavelength radiation which would increase the heat load on the cooling system while transmitting microwaves and millimeter waves. The materials chosen must now be vacuum compatible for space deployment. In addition, it may be desirable to evacuate the space between the shroud and the antenna in order to reduce heat transfer by conduction and convection.

This completes the antenna module per se. The superconducting layers, here the microstrip feed layer 14 and the ground plane 12, must be connected to a heat removal (cooling) system in order to maintain an acceptable operating temperature. The cooling system may employ any means to accomplish its function, but it must make good thermal contact to the layers to be cooled. Because high temperature superconductors are fairly good thermal conductors, physical connection can be made to any part of the superconducting layer.

Another consideration for the efficient operation of the antenna system, when deployed in an earth orbit, is the reduction of blinding by sunshine, moonshine, or earthshine. Whenever the antenna points to a bright star, planet, or satellite the true signal is swamped by the very intense radiation coming from the heavenly body. Not only is there interference at the wavelengths of operation of the antenna, but the blackbody radiation from the interfering object may cause a surge in the temperature of the antenna. The effects of such a surge in the incident radiation can be mitigated by the use of a blinder system. The blinders can be set to activate upon sensing an increase in temperature, according to a predetermined schedule, or when a signal is received from the ground. The blinders block the heat, light, and noise from the object for only the period that the main lobe of the antenna's radiation distribution intersects the object's radiation cone. This is only practical for a very narrow angular distribution from the antenna, such as can be achieved with superconducting antenna elements.

CONCLUSIONS, RAMIFICATIONS, AND SCOPE

It is thus apparent that the present invention has many advantages for the design of microwave antennas useful for telecommunications and telemetry applications. The superconductive elements allow operation over a large bandwidth while maintaining a very narrow beam. Side lobes are suppressed by proper design of the feed, or beam-forming, network, made possible by the use of superconductive materials in this layer. The incorporation of several filtering layers reduces the heat load on the cooling apparatus, allowing the superconducting elements to be maintained at a temperature well below their superconducting transition temperature, without prohibitive size, weight, and cost.

Although many advantages are gained through the use of superconductive materials in the antenna, the radiation shield disclosed herein will also be useful in conjunction with antennas comprising copper or other normal metals whose performance improves with decreasing temperature.

The preceding description of the preferred embodiments emphasizes the use of the microstrip configuration for the antenna. For some applications it may be advantageous to use other configurations, e.g., stripline, barline, dielectric waveguide, or coplanar waveguide. In the coplanar waveguide configuration, for example, nearly the entire plane of the distribution network could be coated with an IR reflector such as gold.

While the above descriptions were written with terminology appropriate for transmit antennas, those skilled in the art will know that the performance in a receive mode can be quickly inferred by considerations of reciprocity from the transmit performance. For example, the "distribution network" in the transmit mode can be labeled the "combining network" in the receive mode. The "area illuminated by the antenna" in the transmit mode is identical to the "area to which the antenna is sensitive" in the receive mode.

Most implementations will be made steerable by the addition of phase-control elements to this feed network. Multibeam implementations may be achieved by the use of multiple feed networks or true time delay beam-forming networks. Sidelobe suppression and/or main beam shaping may be achieved by the use of amplitude or amplitude and phase weighting elements. With the benefit of the above description, those skilled in the an will find many ways to implement and extend the technology described herein. It should be realized that none of these obvious extensions deviate from the intent and scope of the invention, as set forth in the appended claims.

We claim:

1. A radiation shield for a superconductive array antenna, said superconductive array antenna comprising a feed layer and a radiating patch layer, said radiation shield being intermediate the feed layer and the radiating patch layer of the superconductive array antenna, and said radiation shield comprising:

a layer of filtering material, said layer of filtering material being substantially transparent to radiation having wavelengths longer than about 1 millimeter and being substantially opaque to radiation having wavelengths shorter than about 0.1 millimeter.

2. The radiation shield of claim 1, wherein said layer of filtering material further comprises at least one pair of dielectric layers, wherein the two dielectric layers have substantially different dielectric constants.

3. The radiation shield of claim 1, wherein said layer of filtering material further comprises at least two pairs of dielectric layers, wherein the two dielectric layers of each pair have substantially different dielectric constants and wherein the thickness of each of said dielectric layers is identical in each of said pairs.

4. The radiation shield of claim 1, wherein said layer of filtering material further comprises at least two pairs of dielectric layers, wherein the two dielectric layers of each pair have substantially different dielectric constants and wherein the thickness of each of said dielectric layers is different in each of said pairs.

5. The radiation shield of claim 1, wherein said layer of filtering material further comprises a multilayer structure comprising at least three pairs of dielectric layers, wherein the two dielectric layers of each pair have substantially different dielectric constants;

the thickness of alternating dielectric layers of the multilayer structure is monotonically varied, whereby substantially all radiation having wavelengths shorter than about 0.1 millimeter is reflected.

6. The radiation shield of claim 1, further comprising an IR reflective shroud surrounding the antenna.

7. A radiation shield for a superconductive array antenna, said superconductive array antenna comprising a feed layer and a radiating patch layer, and said radiation shield comprising:

a layer of filtering material located intermediate the feed layer of the antenna and the radiating patch layer of the antenna, said filtering layer comprising at least one layer of metal patterned into a planar array of electrically isolated islands, each of said islands having a characteristic dimension in the plane substantially shorter than approximately 1 millimeter.

8. A radiation shield for a superconductive array antenna comprising:

a multilayer dichroic filter comprising first, second and third pairs of dielectric layers, wherein the two dielectric layers of each pair have substantially different dielectric constants;

the pairs of dielectric layers are arranged in a stack wherein the second pair of dielectric layers is intermediate to and in contact with each of the first and third dielectric layers such that adjacent dielectric layers from different pairs have substantially different dielectric constants;

each of the dielectric layers has a thickness and the thickness of alternating dielectric layers of the multilayer filter are monotonically varied, wherein the thickness of the thickest pair is about three times the thickness of the thinnest pair; and the thickness of the layers is chosen such that the filter is substantially transparent to radiation having wavelengths longer than about 1 millimeter and substantially opaque to radiation having wavelengths shorter than about 0.1 millimeter.

* * * * *